US010271600B2

(12) United States Patent
Bryson

(10) Patent No.: US 10,271,600 B2
(45) Date of Patent: Apr. 30, 2019

(54) HEADWEAR FOR PROTECTING THE LONG HAIR OF A WEARER

(71) Applicant: Danyel Denise Bryson, Council Bluffs, IA (US)

(72) Inventor: Danyel Denise Bryson, Council Bluffs, IA (US)

( * ) Notice: Subject to any disclaimer, the term of this patent is extended or adjusted under 35 U.S.C. 154(b) by 136 days.

(21) Appl. No.: 15/441,883

(22) Filed: Feb. 24, 2017

(65) Prior Publication Data

US 2017/0265553 A1 Sep. 21, 2017

Related U.S. Application Data

(60) Provisional application No. 62/311,229, filed on Mar. 21, 2016.

(51) Int. Cl.
*A42B 1/22* (2006.01)
*A42B 1/04* (2006.01)

(52) U.S. Cl.
CPC ..... *A42B 1/225* (2013.01); *A42B 1/041* (2013.01)

(58) Field of Classification Search
CPC ..... A42B 1/225; A42B 1/041
See application file for complete search history.

(56) References Cited

U.S. PATENT DOCUMENTS

2011/0265247 A1* 11/2011 Nolan ..... A42B 1/067 2/181
2017/0265553 A1* 9/2017 Bryson ..... A42B 1/225

* cited by examiner

*Primary Examiner* — Andrew Wayne Sutton
(74) *Attorney, Agent, or Firm* — Dunlap Bennett & Ludwig PLLC

(57) ABSTRACT

A long hair protector apparatus is provided. The apparatus includes a headwear and at least one hair sheath for protecting long hair in either a pigtail or ponytail configuration. The headwear is dimensioned and adapted to be worn on the head of a human wearer, wherein the headwear has a tail portion and a band portion, each providing detachable first fasteners. The tail portion is near the rear neck of the wearer, while the band portion extends around the front of the head, providing the detachable first fasteners near each ear of the wearer, and wherein the band portion provides distal portions for tying together so as to further secure the headwear to the wearer. The hair sheath(s) may be removably attached to the tail portion in the ponytail configuration or to the band portions providing the pigtail configuration.

7 Claims, 5 Drawing Sheets

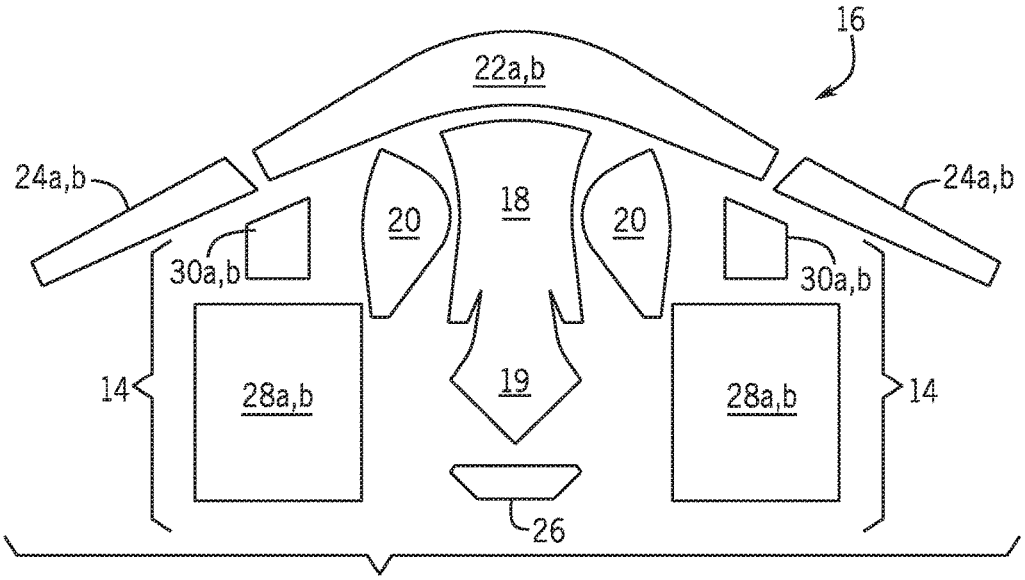
FIG. 3
FIG. 4
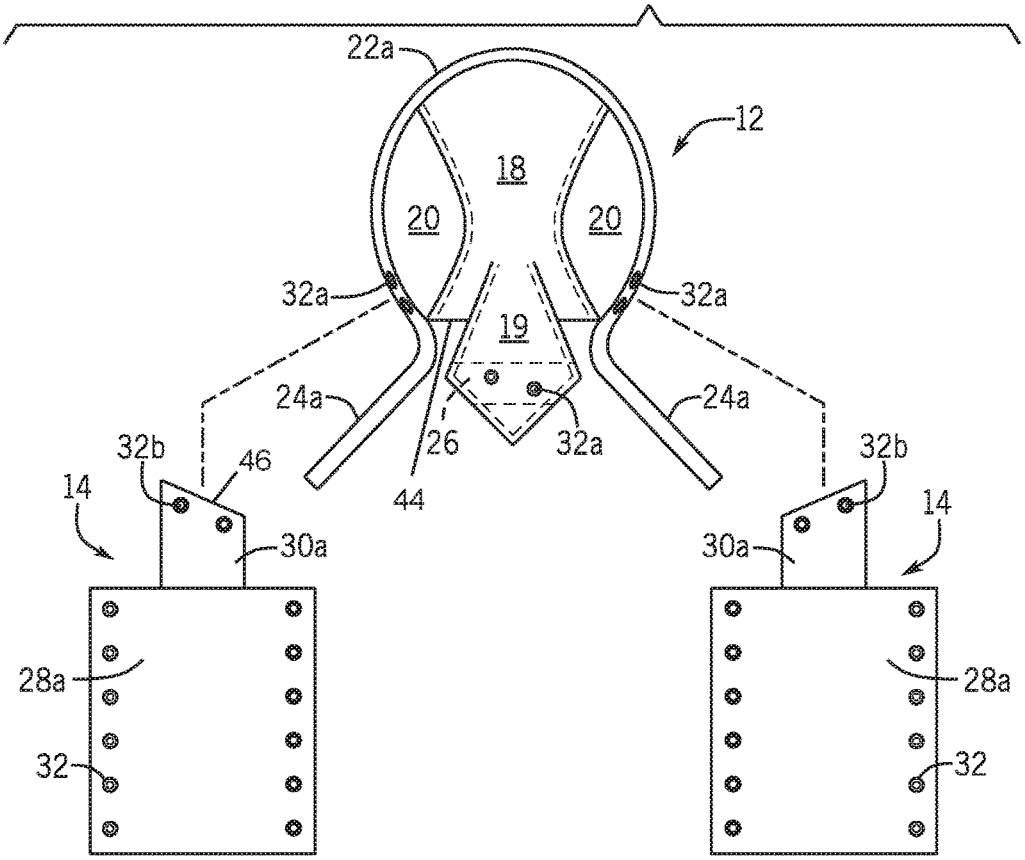

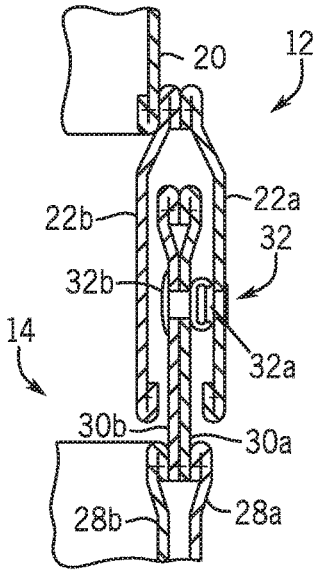
FIG. 5A
FIG. 5B
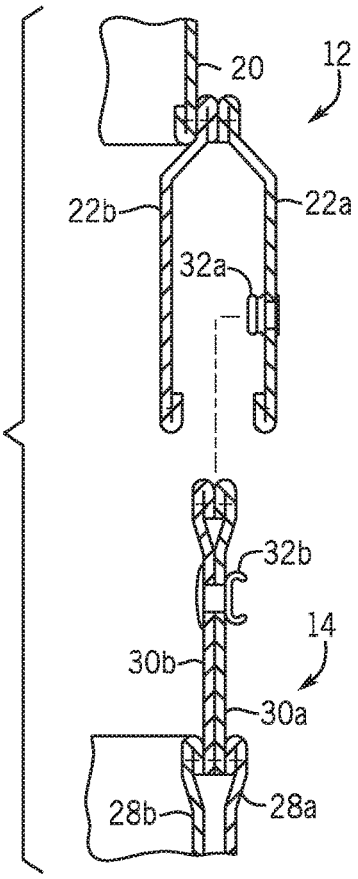

HEADWEAR FOR PROTECTING THE LONG HAIR OF A WEARER

CROSS-REFERENCE TO RELATED APPLICATION

This application claims the benefit of priority of U.S. provisional application No. 62/311,229, filed 21 Mar. 2016, the contents of which are herein incorporated by reference.

BACKGROUND OF THE INVENTION

The present invention relates to hair accessories and, more particularly, to headwear providing hair sheaths for protecting long hair in either a ponytail or pigtail configuration, protecting their long hair from wind and sun damage.

Sun and wind can cause hair damage. And so those with long hair mainly have the option of securing their hair in a ponytail or pigtail, yet the ponytail or pigtail was still typically exposed to the sun and wind even if they wore a hat.

As can be seen, there is a need for an apparatus providing hair sheaths for protecting long hair bunched in either a pigtail or a ponytail, wherein the hair sheaths may be interchangeably secured to a headwear in a convenient, novel manner that prevents tearing of the hair, as hook and loop fasteners tend to tear the hair they secure.

SUMMARY OF THE INVENTION

In one aspect of the present invention, a long hair protection apparatus provides a headwear portion dimensioned and adapted to fit a top of a human head, wherein the headwear extends from a front end to a rear neck end as it circumscribes said top; a band portion joined along a periphery of the front end and extending between opposing distal portions; a plurality of band first fasteners provided by the band portion near both of the distal portions; a neck portion extending from near the rear neck end, the neck portion providing a plurality of neck first fasteners; and a plurality of hair sheaths, each hair sheath providing a plurality of second fasteners adapted to removably attach to the first fasteners.

In another aspect of the present invention, the long hair protection apparatus provides a headwear portion dimensioned and adapted to fit a top of a human head, wherein the headwear extends from a front end to a rear neck end as it circumscribes said top; a band portion joined along a periphery of the front end and extending between opposing distal portions, wherein the both distal portions are dimensioned and adapted to be tied together; a plurality of band first fasteners provided by the band portion in a staggered configuration near both of the distal portions; a neck portion extending from near the rear neck end, the neck portion providing a plurality of neck first fasteners in the staggered configuration; and a plurality of hair sheaths, wherein each hair sheath provides an elongated sheet with peripheral connectors along its two opposing long edges for moving between an unfolded condition and a tubular condition, wherein each hair sheath includes a connector sheet joined to a top edge, wherein each connector sheet provides a plurality of second fasteners in the staggered configuration adapted to removably attach to the first fasteners.

These and other features, aspects and advantages of the present invention will become better understood with reference to the following drawings, description and claims.

BRIEF DESCRIPTION OF THE DRAWINGS

FIG. 3 is a top plan view of the components of an exemplary embodiment of the present invention in an unfolded overall pattern layout;

FIG. 4 is a top plan exploded view of an exemplary embodiment of the present invention;

FIG. 5A is a cross-sectional view of an exemplary embodiment of the present invention, taken along line 5A-5A of FIG. 2;

FIG. 5B is a cross-sectional exploded view of FIG. 5A;

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention includes a long hair protector apparatus providing a headwear and at least one hair sheath for protecting long hair in either a pigtail or ponytail configuration. The headwear is dimensioned and adapted to be worn on the head of a human wearer, wherein the headwear has a tail portion and a band portion, each providing detachable first fasteners. The tail portion is near the rear neck of the wearer, while the band portion extends around the front of the head, providing the detachable first fasteners near each ear of the wearer, and wherein the band portion provides distal portions for tying together so as to further secure the headwear to the wearer. The hair sheath(s) may be removably attached to the tail portion in the ponytail configuration or to the band portions providing the pigtail configuration so they do not slide off the user's hair.

Referring to FIGS. 1 through 9B, the present invention may include a long hair protector apparatus 10. The long hair protector apparatus 10 may include a headwear 12 providing attachment points for removably attaching hair sheaths 14 either in a ponytail configuration or a pigtail configuration. The long hair protector apparatus 10 may be made of durable, flexible, comfortable material fabric such as cotton or comparable synthetics. The separate components of the long hair protector apparatus 10 may be joined by sewn thread or other joining methods; an exemplary oval pattern layout 16 of such components is shown in FIG. 3. The headwear 12 may be in the form or shape of a dew rag as illustrated in the Figures; though additional patterns could be created for different sizes and shapes of headwear 12.

Figure 8:
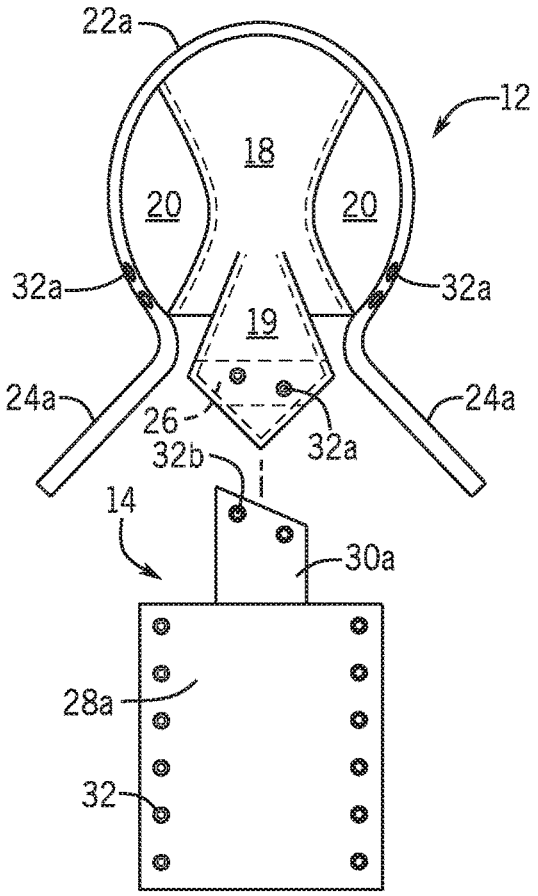
FIG. 8 is a top plan exploded view of an exemplary embodiment of the present invention.
Figure 9A:
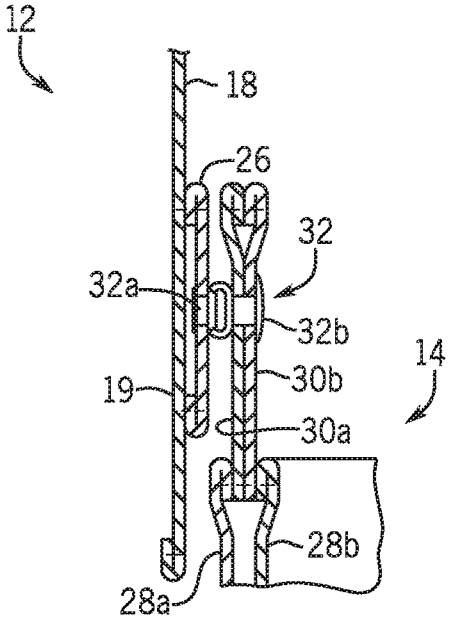
FIG. 9A is a cross-sectional view of an exemplary embodiment of the present invention, taken along line 9A-9A of FIG. 6.
Figure 9B:
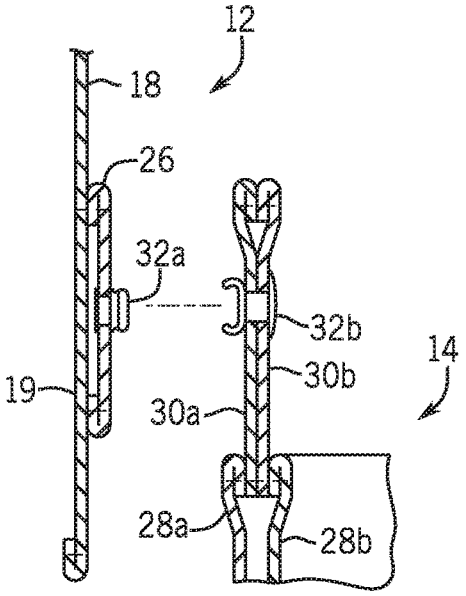
FIG. 9B is a cross-sectional exploded view of FIG. 9A.

The headwear 12 may be dimensioned and adapted to be worn on the head of a human user. The headwear 12 includes a top portion 18 that extends from a front end 42 to a tail end 44. The front end may be associated with the human wearer for the span from near one ear along the forehead and to near the other ear. The tail end 44 may be associated with the rear of the wearer's neck. The top portion 18 may include side portions 20 that run along the adjacent opposing sides of the top portion 18. Near the tail end 44, a tail portion 19 may be provides so as to extend beyond the tail end 44. The tail portion 19 may have the shape of the lower portion of a neck tie, as illustrated in the figures. A fastener holder 26 may be provided by the tail portion 19 to secure detachable first fasteners 32*a* of a plurality of detachable fasteners 32 thereto. In FIGS. 4 and 8, the fastener holder 26 is disposed along an inner surface (thus the broken lines) of the tail portion 19 along with the detachable first fasteners 32*a*. Though in certain embodiment, the plurality of detachable fasteners 32 may be disposed along the outer-facing surface of the tail portion 19.

Figure 1:
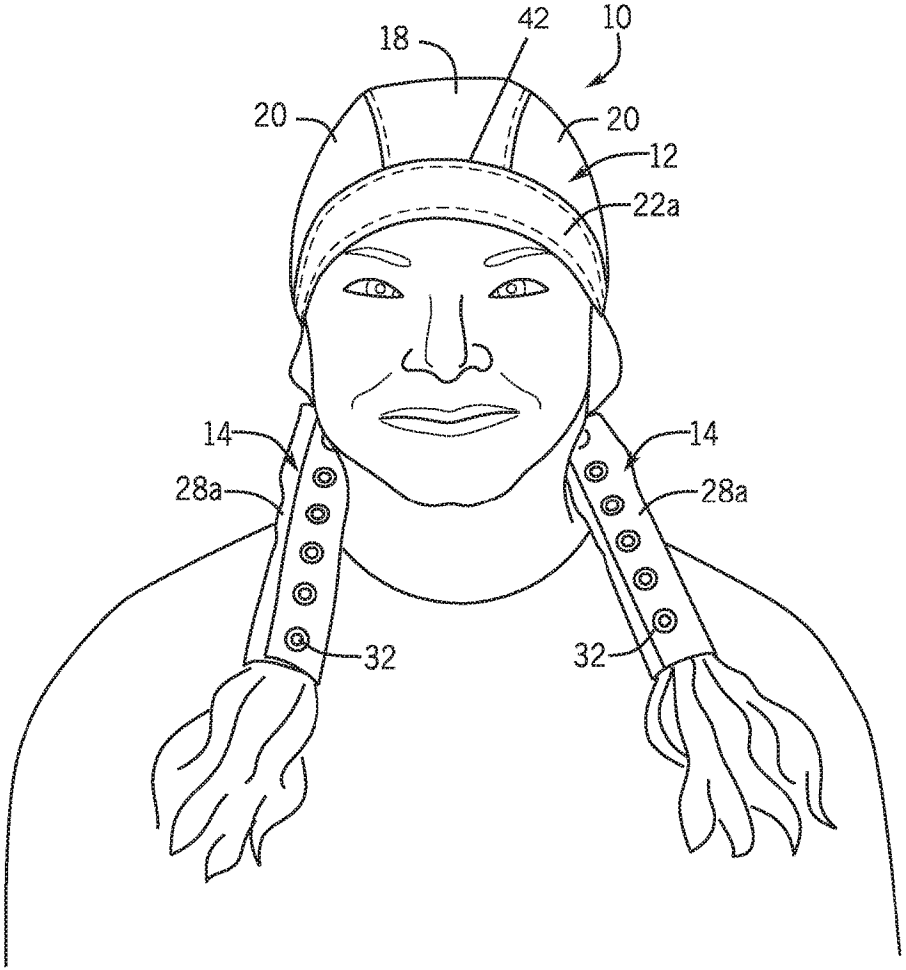
FIG. 1 is a front elevation view of an exemplary embodiment of the present invention, shown in use in a pigtail configuration.
Figure 2:
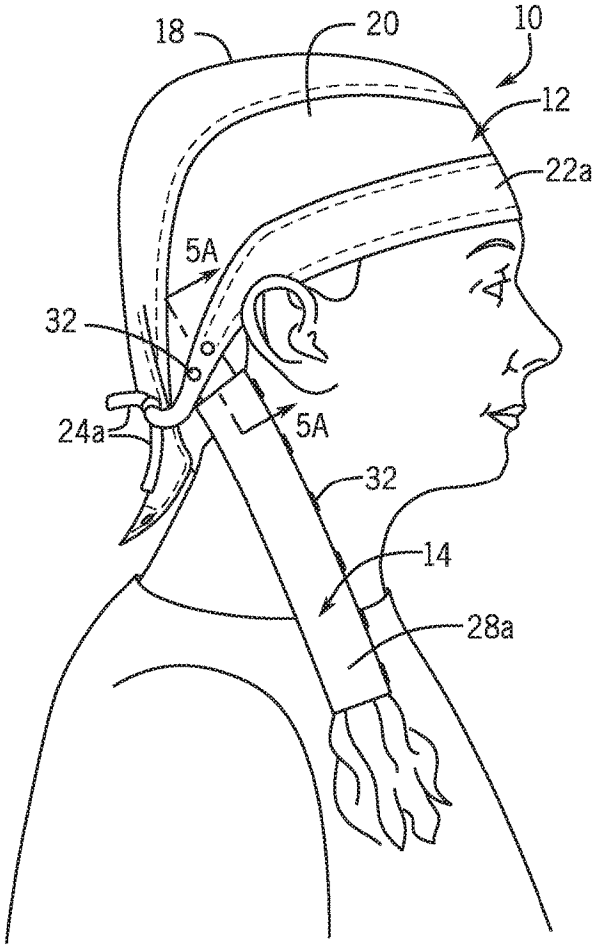
FIG. 2 is a side elevation view of an exemplary embodiment of the present invention, shown in use in the pigtail configuration.
Figure 7:
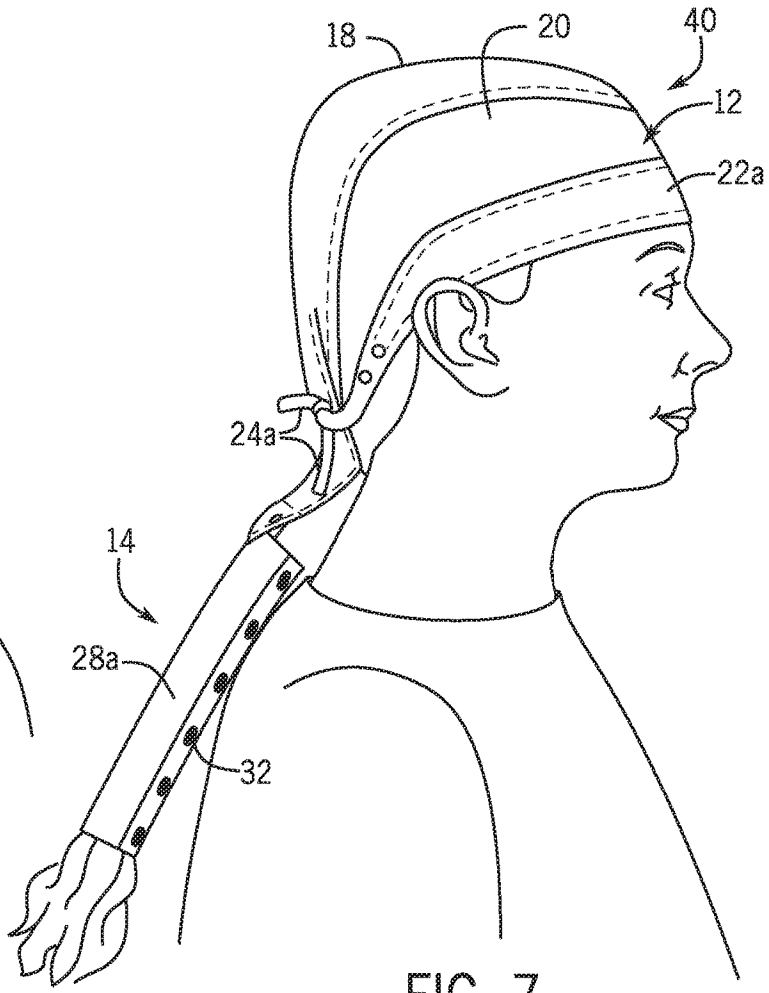
FIG. 7 is a side elevation view of an exemplary embodiment of the present invention, shown in use in the ponytail configuration.
Figure 6:
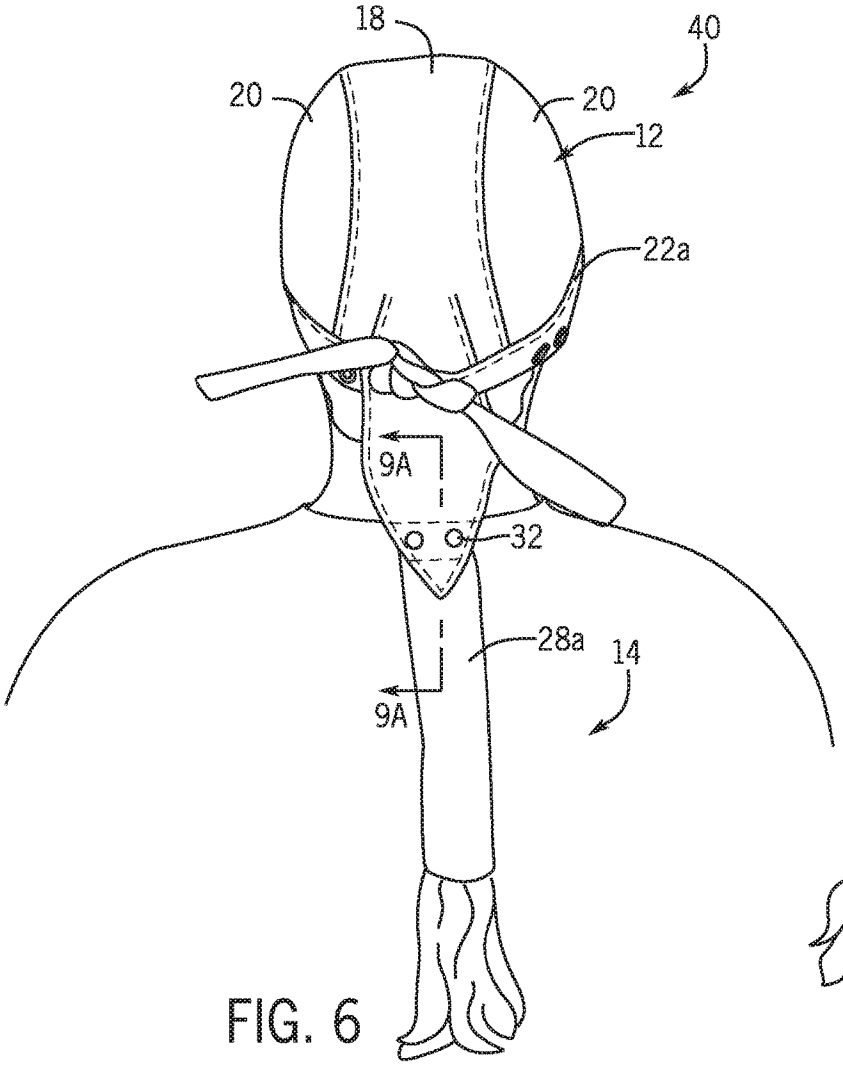
FIG. 6 is a rear elevation view of an exemplary embodiment of the present invention, shown in use in a ponytail configuration.

A band portion 22*a* may be joined along a periphery of the headwear 12 so that a distal portion 24*a* wraps along the front and beyond the neck end 44 on each side of the headwear 12 in the form of distal portions 24*a*, as illustrated in the Figures. The opposing distal portions 24*a* may be dimensioned to be able to be tied together adjacent to the neck end 44, as illustrated in FIG. 2, so as to further secure the headwear 12 to the wearer.

The band portions 22*a* and the distal portions 24*a* may provide a spaced apart coextensive band liner 22*b* and distal liner 24*b*, respectively, wherein the band 22*a* and the distal portions 24*a* are outward facing and the band liner 22*b* and the distal liner 24*b* are inward facing, as illustrated in FIGS. 5A and 5B. The band portion 22*a* and the band liner 22*b* are joined together to the headwear 12 along a top edge, while not joined along an opposing bottom edge, essentially forming a pocket therebetween. The band portion 22*a* may provide detachable first fasteners 32*a* near or adjacent to the neck edge 44 and wear's ear on both sides of the headwear 12.

Each hair sheath 14 may include an elongated sheet 28*a* and a connector sheet 30*a*. The elongated sheet 28*a* and the connector sheet 30*a* may have coextensive sheet liners 28*b* and connector liners 30*b*, respectively. The elongated sheet 28*a* may be rolled from an unfolded condition into a tubular condition so as to house a braided or bunched segment of long hair. Each elongated sheet 28*a* may have detachable fasteners 32 along its long edges so as to secure the tubular condition. The connector sheet 30*a* may be connected to a top edge of the elongated sheet 28*a* so as to further extend the hair sheath 14 along its longitudinal axis. The connector sheet 30*a* may extend to a slanted edge 46, along which detachable second fasteners 32*b* of detachable fasteners 32 are disposed in a slanted, staggered configuration as illustrated in FIG. 4.

The detachable second fasteners 32*b* are adapted to removably engage the above-mentioned detachable first fasteners 32*a* disposed along the band 22*a* and the tail portion 19 in order to interchangeably effectuate the pigtail configuration or the ponytail configuration, respectively. When connecting to the band portion 24*a*, the connector sheet 30 may be slid into the pocket between the band portion 24 an and its liner 24*b*, as illustrated in FIGS. 5A and 5B. The detachable first and second fasteners 32*a* and 32*b* may by the studs and sockets of snaps.

A method of using the present invention may include the following. The long hair protector apparatus 10 disclosed above may be provided. A user may don the headwear 12 and tie the distal portions 24*a*. Then the user may attach the hair sheath or sheaths 14 in the pigtail or ponytail configuration, wherein the user secures their long hair within the hair sheath(s) 14 in their tubular condition. Of course, the user may provide a pig and ponytail configuration simultaneously with three hair sheaths 14.

It should be understood, of course, that the foregoing relates to exemplary embodiments of the invention and that modifications may be made without departing from the spirit and scope of the invention as set forth in the following claims.

What is claimed is:

1. A long hair protector apparatus, comprising:

a headwear portion dimensioned and adapted to fit a top of a human head, wherein the headwear extends from a front end to a rear neck end as it circumscribes said top;

a band portion joined along a periphery of the front end and extending between opposing distal portions;

a plurality of band first fasteners provided by the band portion near both of the distal portions;

a neck portion extending from near the rear neck end, the neck portion providing a plurality of neck first fasteners; and a plurality of hair sheaths, each hair sheath providing a plurality of second fasteners for removably attaching to the first fasteners of either the neck portion or the band portion.

2. The long hair protector apparatus of claim 1, wherein each hair sheath provides an elongated sheet with peripheral connectors along its two opposing long edges for moving between an unfolded condition and a tubular condition.

3. The long hair protector apparatus of claim 2, wherein each hair sheath includes a connector sheet joined to a top edge, wherein each connector sheet provides the plurality of second fasteners.

4. The long hair protector apparatus of claim 3, wherein the plurality of second fasteners are in a staggered configuration.

5. The long hair protector apparatus of claim 4, wherein the plurality of band and neck first fasteners are in the staggered configuration.

6. The long hair protector apparatus of claim 1, wherein the both distal portions are dimensioned and adapted to be tied together.

7. A long hair protector apparatus, comprising:

a headwear portion dimensioned and adapted to fit a top of a human head, wherein the headwear extends from a front end to a rear neck end as it circumscribes said top;

a band portion joined along a periphery of the front end and extending between opposing distal portions, wherein the both distal portions are dimensioned and adapted to be tied together;

a plurality of band first fasteners provided by the band portion in a staggered configuration near both of the distal portions;

a neck portion extending from near the rear neck end, the neck portion providing a plurality of neck first fasteners in the staggered configuration; and a plurality of hair sheaths, wherein each hair sheath provides an elongated sheet with peripheral connectors along its two opposing long edges for moving between an unfolded condition and a tubular condition, wherein each hair sheath includes a connector sheet joined to a top edge, wherein each connector sheet provides a plurality of second fasteners in the staggered configuration for removably attaching to the first fasteners of either the neck portion or the band portion.

* * * * *